US011289243B2

(12) United States Patent
Langens et al.

(10) Patent No.: US 11,289,243 B2
(45) Date of Patent: Mar. 29, 2022

(54) PLUGGABLE HIGH-VOLTAGE BUSHING AND ELECTRICAL DEVICE HAVING A PLUGGABLE HIGH-VOLTAGE BUSHING

(71) Applicant: SIEMENS AKTIENGESELLSCHAFT, Munich (DE)

(72) Inventors: Achim Langens, Lohmar (DE); Tim Schnitzler, Kreuzau (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 187 days.

(21) Appl. No.: 16/630,505

(22) PCT Filed: Jul. 12, 2017

(86) PCT No.: PCT/EP2017/067584
§ 371 (c)(1),
(2) Date: Jan. 13, 2020

(87) PCT Pub. No.: WO2019/011426
PCT Pub. Date: Jan. 17, 2019

(65) Prior Publication Data

US 2020/0168370 A1 May 28, 2020

(51) Int. Cl.
*H01B 17/28* (2006.01)
*H01F 27/04* (2006.01)

(52) U.S. Cl.
CPC ..... *H01B 17/28* (2013.01); *H01F 27/04* (2013.01)

(58) Field of Classification Search
CPC ..... H01B 17/28; H01B 17/26; H01F 27/04; H01F 27/2828; H01F 27/02; H02G 15/072; H01H 9/02; H01H 9/0264; H01H 85/185
USPC ..... 174/152 R, 142, 152 G, 153 G, 138 R, 174/139, 138 F, 137 R, 5 R, 14 BH; 16/2.1, 2.2
See application file for complete search history.

(56) References Cited

U.S. PATENT DOCUMENTS

| | | | | |
|---|---|---|---|---|
| 2,322,215 | A | 6/1943 | Kirkwood et al. | |
| 7,742,676 | B2 * | 6/2010 | Tilliette | H01B 17/28 385/138 |
| 7,964,799 | B2 * | 6/2011 | Isberg | H01F 27/04 174/152 R |
| 8,003,891 | B2 * | 8/2011 | Rocks | H01B 17/28 174/152 R |
| 8,150,230 | B2 * | 4/2012 | Tilliette | H01B 17/28 385/138 |

(Continued)

FOREIGN PATENT DOCUMENTS

| | | | |
|---|---|---|---|
| DE | 102007022641 | A1 | 11/2008 |
| EP | 2431982 | A1 | 3/2012 |
| WO | WO2010086248 | A1 | 8/2010 |

*Primary Examiner* — Angel R Estrada
(74) *Attorney, Agent, or Firm* — Laurence A. Greenberg; Werner H. Stemer; Ralph E. Locher

(57) ABSTRACT

A pluggable high-voltage bushing includes an inner conductor which extends in a longitudinal direction between a high-voltage terminal and a plug-in section of the high-voltage bushing. The plug-in section is configured to plug the high-voltage bushing into a device connection part of an electrical device. An insulating body surrounds the inner conductor. The insulating body includes a textile sheet-like structure. An electrical device having the high-voltage bushing is also provided.

15 Claims, 3 Drawing Sheets

(56) References Cited

U.S. PATENT DOCUMENTS

| | | | | |
|---|---|---|---|---|
| 8,319,101 | B2 * | 11/2012 | Adachi | H02G 15/064 174/73.1 |
| 8,455,763 | B2 | 6/2013 | Dais et al. | |
| 8,471,150 | B2 * | 6/2013 | Emilsson | H01B 17/28 174/143 |
| 8,637,773 | B2 * | 1/2014 | Jonsson | B29C 70/58 174/137 B |
| 8,716,601 | B2 * | 5/2014 | Xu | H01B 17/42 174/142 |
| 8,861,165 | B2 * | 10/2014 | Kampe | H01C 1/14 361/118 |
| 8,969,729 | B2 * | 3/2015 | Jahnel | H01B 3/52 174/142 |
| 2011/0286145 | A1 | 11/2011 | Langens et al. | |

* cited by examiner

PLUGGABLE HIGH-VOLTAGE BUSHING AND ELECTRICAL DEVICE HAVING A PLUGGABLE HIGH-VOLTAGE BUSHING

BACKGROUND OF THE INVENTION

Field of the Invention

The invention relates to a pluggable high-voltage bushing having an inner conductor which extends in a longitudinal direction between a high-voltage terminal and a plug-in section of the high-voltage bushing, wherein the plug-in section is configured to plug the high-voltage bushing into a device connection part of an electrical device, and having an insulating body which surrounds the inner conductor.

In general, the function of a high-voltage bushing of this type is to insulate the inner conductor of the high-voltage bushing which, during the operation of said high-voltage bushing, assumes a high-voltage potential, from an environment which is at a ground potential, for example a wall of a high-voltage installation. To this end, the inner conductor is fed through the insulating body.

A high-voltage bushing of the above-mentioned type is known from DE 10 2007 022 641 A1. Herein, a transformer is disclosed, the housing of which comprises a device connection part, into which a high-voltage bushing is insertable for the connection of the transformer to a high-voltage grid. By the employment of a pluggable high-voltage bushing of this type, it is possible for the transformer, with the high-voltage bushing, to be developed and brought into service with a relatively low complexity of assembly.

The plug-in section of the high-voltage bushing and the device connection part are configured such that a reliable electrical contact can be constituted between the inner conductor of the high-voltage bushing and the device connection part, wherein the device connection part is electrically connected to further elements of the electrical device such as, for example, an active part of the electrical device which is arranged within the housing. At the same time, the connection at the contact surfaces between the device connection part and the plug-in section is sufficiently dielectrically secure to permit operation at a high-voltage level.

For the production of the insulating body, insulating layers of paper are customarily wound around the inner conductor.

SUMMARY OF THE INVENTION

The object of the invention is to provide the pluggable high-voltage bushing of the above-mentioned type which shows an increased dielectric strength.

In a generic high-voltage bushing, this object is fulfilled wherein the insulating body comprises a textile sheet-like structure.

According to the invention it is proposed that, in addition to or in place of paper, the textile sheet-like structure is employed in the insulating body. One advantage of the invention is provided, in that the textile sheet-like structure prevents, or can at least reduce the penetration of moisture into the insulating body of the high-voltage bushing. Therefore, the electrical properties of the high-voltage bushing, such as dielectric strength, can be improved. Within the meaning of the invention, a textile sheet-like structure is to be understood as a flat structure such as, for example, a woven fabric, a mesh or a non-woven fabric.

The textile sheet-like structure preferably comprises a water-repellent base material, such that the penetration of moisture into the textile sheet-like structure is prevented. Moisture would result in a reduction of dielectric strength. The base material is preferably initially configured as a flexible winding layer which, during the manufacture of the high-voltage bushing, is wound about the inner conductor. The winding is then immersed in a liquid resin, which is subsequently cured.

The textile sheet-like structure is preferably a non-woven fabric. The non-woven fabric can be constituted, for example, of fibers or filaments of any length, preferably of a finite length, or can incorporate the latter. It is also conceivable for the non-woven fabric to comprise "endless filaments". The term endless filaments describes fibers of unlimited length. The non-woven fabric can be, for example, a plastic non-woven fabric, preferably a synthetic plastic non-woven fabric. A plastic non-woven fabric is characterized by plastic fibers which constitute the non-woven material.

According to a further form of embodiment of the invention, the insulating body incorporates capacitive control inserts, which are separated from one another by insulating layers, wherein the insulating layers comprise the non-woven fabric, and wherein the control inserts are arranged concentrically around the inner conductor and extend into the plug-in section. The function of the capacitive control inserts is the capacitive field control of the electric field of the high-voltage bushing during the operation thereof. The control inserts extend into the plug-in section of the high-voltage bushing. In this manner, the electric field can also be effectively controlled in the plug-in region, such that the sensitive region of the connection between the device connection part and the high-voltage bushing shows improved electrical properties. According to this form of embodiment, insulating layers of non-woven fabric replace the paper insulating layers which are known from the prior art. In-house investigations have shown that the use of insulating layers of non-woven fabric produces control inserts of a more consistent surface area than that associated with the corresponding use of paper. Consistency of the surface area of control inserts results in improved field control, associated with the reduction of field elevations on the control inserts. A further improvement in the electrical properties of the high-voltage bushing is thus achieved. In the pluggable high-voltage bushing, this advantage is of particular significance, as consistent field control in the plug-in section of the high-voltage bushing is of particular importance to the achievement of the requisite dielectric strength in this restricted assembly space.

The non-woven fabric is preferably comprised of a synthetic polymer. The synthetic polymer can be, for example, a polyester, wherein a polyethylene terephthalate (PET) is specifically preferred. Synthetic polymers are apolar, and are thus moisture-repellent.

According to one form of embodiment of the invention, a radial distance between the control inserts lies between 1 mm and 3 mm, wherein a distance between 1.5 mm and 2.5 mm is specifically preferred. By means of this preferred distance, an effective discharge of the electric field can be achieved, even in consideration of the any mechanical deformation sustained by the non-woven fabric insulating layers during the manufacturing process. Appropriately, any variation in the distance is less than 0.5 mm and preferably less than 0.2 mm, wherein a variation of less than 0.1 mm is specifically preferred. An advantageously smooth surface of the control inserts is provided accordingly. In the manufacturing process, the smoothness of the control inserts is influenced by an appropriate adjustment of the winding path during the winding of the insulating layers and the control inserts.

The insulating body preferably comprises a cured resin. For example, during the manufacturing process, the high-voltage bushing can be impregnated with a curable resin, for example after the winding of the insulating layers. After the curing of the resin, a more effectively insulated insulating body can thus be obtained. The insulating body is constituted in the form of a compact block, such that any main insulation in the form of a gas can be omitted.

The high-voltage bushing preferably extends, in the longitudinal direction, to a length of 2 m to 30 m, wherein a length between 6 m and 10 m is specifically preferred.

The high-voltage bushing can thus be specifically employed, even for operating voltages in excess of 500 kV. The inner conductor can be configured as a hollow conductor or as a solid conductor. The inner conductor can be comprised, for example, of copper or aluminum.

The inner conductor preferably has an external diameter of at least 5 cm. The high-voltage bushing can thus be employed, even for operating currents in excess of 2 kA.

According to one form of embodiment of the invention, the plug-in section comprises an outer coating of a flexible insulating coating material. The outer coating can extend, for example, over a proportion of the outer surface of the plug-in section, preferably over that proportion thereof which, upon the insertion of the high-voltage bushing into the device connection part, is in contact with the latter. The coating permits a particularly effective dielectric stabilization of the joint produced upon plugging-in. The coating is preferably comprised of silicone.

Appropriately, the high-voltage bushing further comprises a mounting flange for the attachment of the high-voltage bushing to a housing of the electrical device.

The invention further relates to an electrical device having a fluid-tight housing and a high-voltage bushing.

A device of this type is known from the above-mentioned DE 10 2007 022 641 A1.

The object of the invention is the provision of a device of this type having an increased dielectric strength.

This object is fulfilled by a generic electrical device, wherein the high-voltage bushing is a high-voltage bushing having an inner conductor which extends in a longitudinal direction between a high-voltage terminal and a plug-in section of the high-voltage bushing, the plug-in section is configured to plug the high-voltage bushing into a device connection part of an electrical device, an insulating body surrounds the inner conductor, the insulating body includes a textile sheet-like structure, and the device connection part is provided for the accommodation and contact-connection of the high-voltage bushing.

The advantages of the electrical device according to the invention particularly proceed from the above-mentioned advantages of the high-voltage bushing according to the invention.

The device connection part is preferably fastened to the housing by means of a fastening section, from which a hollow locating section of an electrically non-conductive insulating material extends into the housing wherein, at a closed and tapered end region, a metallic contact part is arranged, which extends through the insulating material of the locating section, or prolongs the latter in the direction of the closed end region. According to this form of embodiment of the invention, each device connection part comprises an exposed end, approximately at the height of a housing cover of the housing, which permits the plugging-in of the plug-in section of the high-voltage bushing. In the plug-in direction, a locating section extends from the fastening section of the device connection part into the interior of the housing, wherein the locating section is formed of an insulating material which provides the requisite insulation between the contact piece which, in service, assumes a high-voltage potential, and the housing of the electrical device, for example of a transformer, which lies at a ground potential. In order to provide the requisite dielectric strength at this point, the locating section and the plug-in section are configured with mutually complementary shaping such that, with the assistance of the inherent weight of the high-voltage bushing, the plug-in section is compressed securely against the inner wall of the locating section such that, in this manner, an adequate dielectric strength is ensured between the high-voltage bushing and the device connection part.

The contact part is preferably connected to a winding, for example a winding of a transformer, by means of a winding connection line which extends within the housing. By the plugging of high-voltage bushing into the device connection part, the inner conductor of the high-voltage bushing engages with the contact part, such that the high-voltage terminal of the high-voltage bushing is connected to a winding of the electrical device via the winding connection line.

According to a further form of embodiment of the invention, the winding connection line is equipped with a current sensor, for example a current converter. As the current sensor is arranged within the housing, there is no longer any necessity for the complex integration of the current sensor during the installation of the electrical device in situ in the line section. In other words, the electrical device according to the invention can be rapidly brought into service in situ. This embodiment eliminates a complex installation operation for the current sensor. Appropriately, assembly openings are provided in the housing, in order to permit access to the current sensor or sensors, further to the release of the insulating fluid.

BRIEF DESCRIPTION OF THE SEVERAL VIEWS OF THE DRAWING

The invention is described in greater detail hereinafter, with reference to FIGS. 1 to 4.

DESCRIPTION OF THE INVENTION

Figure 1:
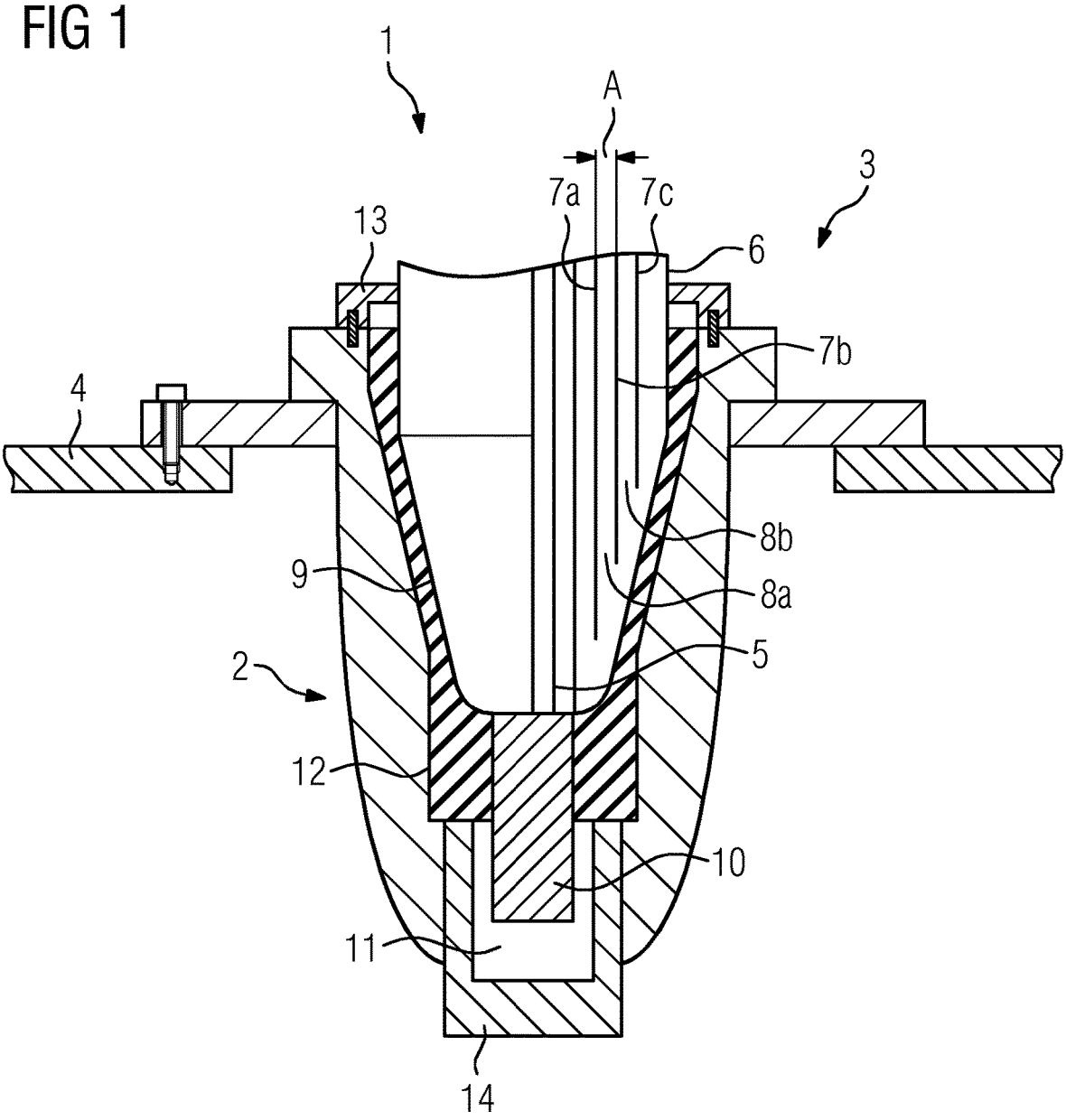
FIG. 1 shows a first exemplary embodiment of a high-voltage bushing according to the invention, in a schematic cross-sectional representation.

Specifically, FIG. 1 represents a partial section of a pluggable high-voltage bushing 1. The high-voltage bushing, in the representation according to FIG. 1, is plugged into a device connection part 2 of a high-voltage electrical device in the form of a transformer 3. The device connection part 2 is fastened to a housing wall 4. The housing wall 4 is part of a transformer housing of the transformer 3, which is filled with an insulating medium, for example insulating oil. The fastening of the device connection part to the housing is executed in an insulating medium-tight manner, such that the insulating medium cannot escape from the housing. The device connection part 2 comprises a conductive connection part 14 for the constitution of an electrical connection between the high-voltage bushing 1 and a winding of the transformer 3, which is not represented in the figure, which is arranged within the insulating oil-filled housing.

The high-voltage bushing 1 comprises an inner conductor 5, which is configured as a hollow conductor of aluminum or copper. The inner conductor 5 is concentrically enclosed in an insulating body 6. The insulating body 6 comprises conductive control inserts 7*a-c* for capacitive field control, which are concentrically wound about the inner conductor 5. The control inserts 7*a-c* are separated from one another by insulating layers 8*a-b* of a non-woven PET fabric, which have been impregnated with resin further to the winding thereof onto the inner conductor 5. The control inserts 7*a-c* are arranged with a radial distance A from one another of 2 mm.

The high-voltage bushing 1 further comprises a plug-in section 9 for the plugging of the high-voltage bushing 1 into the device connection part 2. The plug-in section 9 comprises a conically tapering part of the insulating body 6, and a connecting conductor section, which is welded to the inner conductor 5 in the form of a conductor bolt 10. A contact system 11 engages with the conductor bolt 10, which constitutes the electrical connection between the high-voltage bushing 1 and the transformer 3.

An interspace 12 between the plug-in section 9 of the high-voltage bushing 1 and the device connection part 2 is filled with a silicone material, which dielectrically strengthens the interspace 12.

Figure 2:
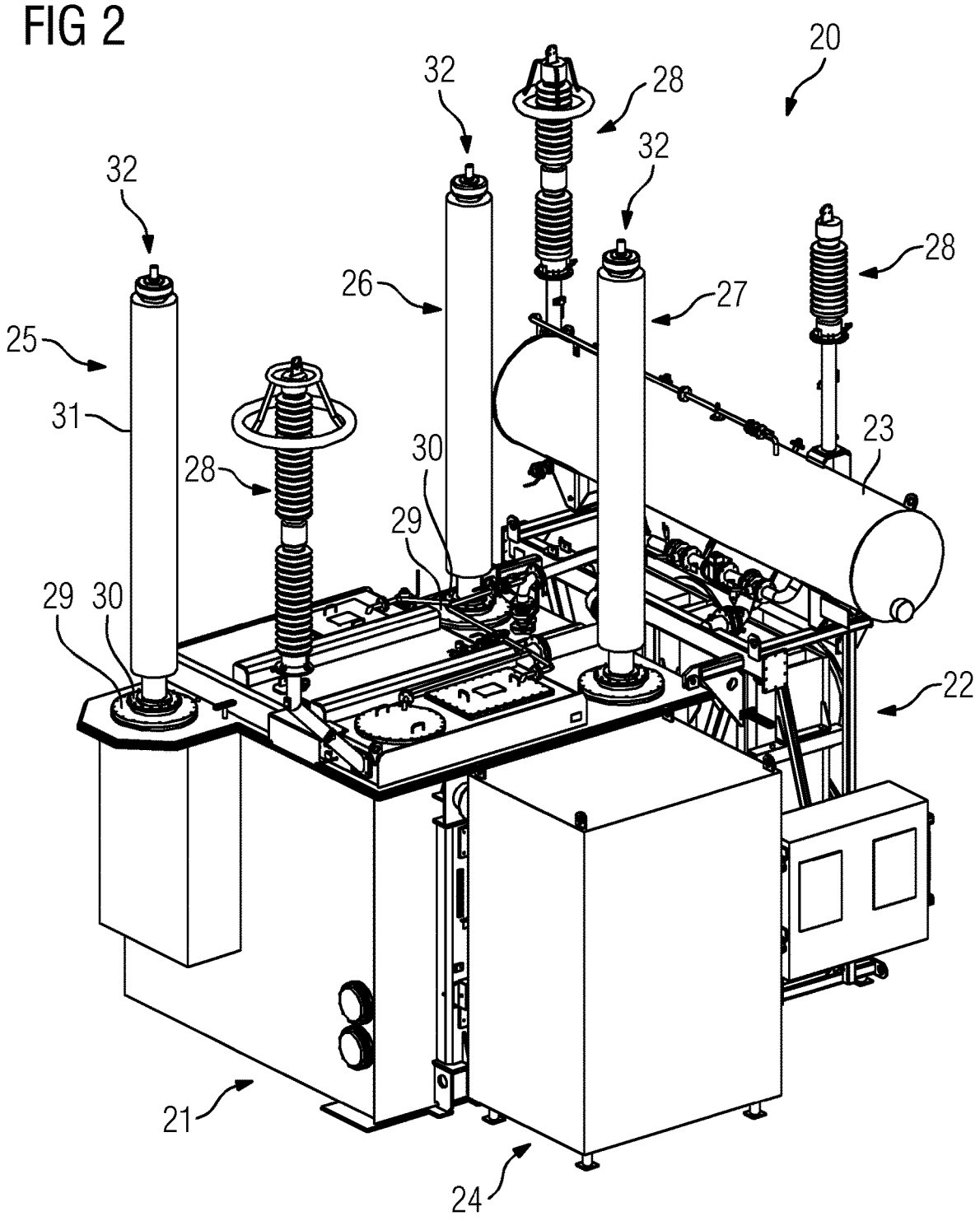
FIG. 2 shows an exemplary embodiment of an electrical device according to the invention having a high-voltage bushing according to the invention, in a schematic perspective representation.

FIG. 2 shows a perspective view of an exemplary embodiment of an electrical device according to the invention, which is configured here as a transformer 20. The transformer 20 comprises a housing 21, which is equipped with a cooling module 22, an expansion tank 23, an auxiliary current module 24 and high-voltage bushings 25-27. The above-mentioned components or modules are detachably connected to one another, and can thus be easily removed and transported in a mutually independent manner. For the protection of the high-voltage bushings 25-27, and of the active part of the transformer 20 which is arranged in the housing 21, i.e. a higher-voltage winding which is connected to the high-voltage bushing 25 or 26, a lower-voltage winding which is connected to the high-voltage bushing 27, and a core of the windings, diverters 28 are provided which, within their respective diverter housing, constitute a non-linear resistance which, in the event of overvoltages, switches over from a non-conductive state to a conductive state, thereby protecting components which are parallel-connected thereto.

The high-voltage bushings 25-27 are once again configured as pluggable high-voltage bushings and, at their plug-in section 33 (FIG. 3), can be inserted into matching device connection parts 29 of the transformer 20. The device connection parts 29 are configured to a rotationally symmetrical design, and delimit a recess, the opening of which faces the housing cover, and is configured with a complementary shaping to the respective plug-in section of the high-voltage bushing 25-27. The device connection parts 29 are moreover fastened to the housing 21 in a fluid-tight manner, such that the interior or the oil reservoir of the single-phase transformer 20 is sealed from the external atmosphere in an insulating medium-tight, i.e. an air- and fluid-tight manner. At one closed end of the device connection part 29, a bolt, which is not visible in the figure, is held as a contact part which, when the high-voltage bushing 25, 26 or 27 is inserted into the respective device connection part 29, engages in conductive contact with an inner conductor which extends through the respective high-voltage bushing 25-27. Said bolt extends into the interior of the housing 21, i.e. into the oil reservoir thereof, where it engages in contact with a winding connection line, which thus electrically connects the device connection part 29 to the respective lower- or higher-voltage winding of the transformer 20.

For the fitting and attachment of the high-voltage bushing 25, 26 or 27, each of the latter comprises a fixing terminal 30. From the fixing terminal 30, a column section 31 extends to a high-voltage terminal 32 which, in the exemplary embodiment represented in FIG. 2, is an exterior terminal.

Each high-voltage bushing 25, 26 or 27 comprises an insulating body 251, through which an inner conductor 252 extends. The insulating body 251 incorporates conductive control inserts 253*a-c*, which are arranged concentrically around the inner conductor 252. The control inserts 253*a-c* are separated from one another by insulating layers of a synthetic plastic non-woven fabric. Further to the winding of the insulating layers and the control inserts around the inner conductor 252, the insulating body 251 is impregnated with resin. A number of the control inserts 253*a-c* extend into the plug-in section 33 of the high-voltage bushing 25. It should be observed that the number of three control inserts represented diagrammatically in FIGS. 1 and 3 is indicated by way of illustration only, and said number is naturally not restricted to three.

Figure 3:
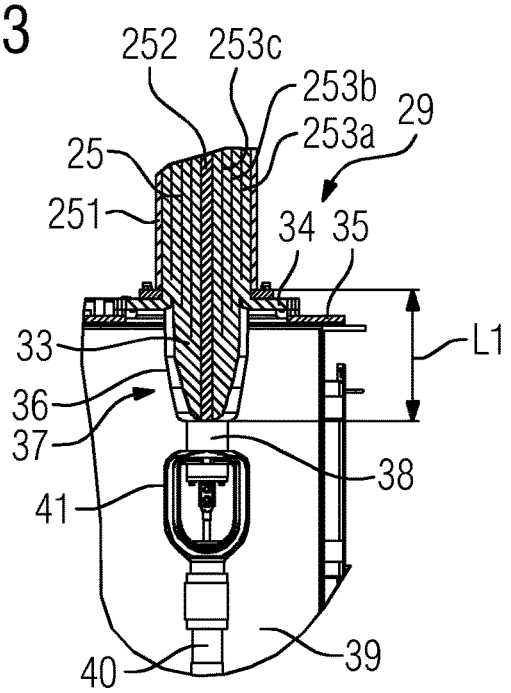
FIG. 3 shows a schematic sectional view of the plug-in section of the high-voltage bushing and of a device connection part of the electrical device according to FIG. 2.

FIG. 3 shows a sectional side view of a device connection part 29 and the high-voltage bushing 25, wherein the high-voltage bushing 25, by means of a plug-in section 33, is inserted into the device connection part 29. In the present exemplary embodiment, the remaining high-voltage bushings 26 and 27 from FIG. 2 are of identical design to the high-voltage bushing 26.

It can be seen that the device connection part 29 comprises a fixing section 34, by means of which the latter is securely fastened to a cover 35 of the housing 21. Appropriate screw connections, for example, are employed for this purpose. In order to permit the insulating medium-tight fastening of the device connection part 29 to the housing 21, sealing means are provided, which are not represented in the figures.

Figure 4:
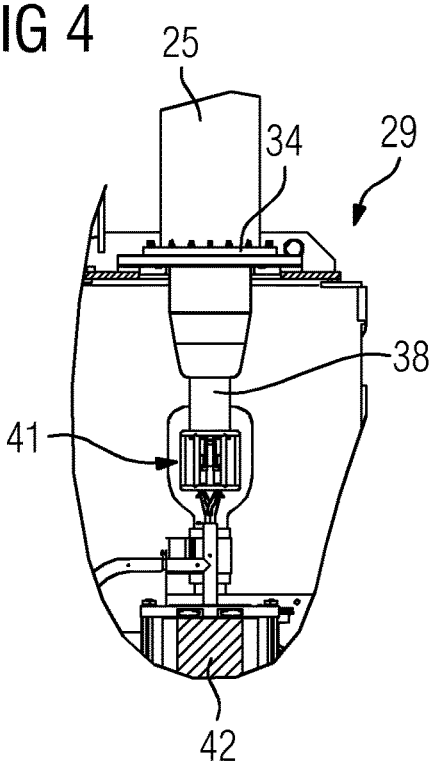
FIG. 4 shows a non-sectional side view of the device connection part, having the high-voltage bushing according to FIGS. 2 and 3.

Each device connection part 29 further comprises a locating section 36, which is comprised of an electrically non-conductive material. The locating section 36 tapers to a closed end 37. At the closed end 37, the wall of the locating section 36 is penetrated by a bolt-shaped contact part 38. At the section thereof which penetrates into the interior 39 or the oil reservoir of the housing 21, the contact part 38 is connected to a winding connection line 40 and a screening cap 41, as shielding. The winding connection line 40 is further equipped with a current sensor in the form of a current converter 42 (FIG. 4). The current converter 42 is thus permanently installed in the housing, and its function is to detect an electric current flowing to or from the respective winding via the winding connection line 40.

The plug-in section 33 of the high-voltage bushing 25 extends from the fixing section 34 into the locating section 36 of the device connection part 29. The plug-in section 33 is configured with complementary shaping to the locating section 36, such that said two components engage with an exact fit, and the ingress of air, or any other infiltrations, can be prevented.

FIG. 4 shows a non-sectional side view of the pluggable bushing 10. In this view, the configuration of the locating section 36 and the current converter 42, and the position thereof relative to the remaining components, can be seen particularly clearly. Moreover, statements indicated with regard to FIG. 3 apply correspondingly.

The invention claimed is:

1. An electrical device, comprising:

a fluid-tight housing having a housing cover;

a pluggable high-voltage bushing having a high-voltage terminal; and a device connection part for accommodation and contact-connection of said high-voltage bushing, said device connection part having an exposed end at a height of said housing cover, and said device connection part having a fixing section connecting said device connection part to said housing cover;

said high-voltage bushing including:

a plug-in section configured to plug said high-voltage bushing into said device connection part, an inner conductor extending in a longitudinal direction between said high-voltage terminal and said plug-in section, and an insulating body surrounding said inner conductor, said insulating body including a textile sheet-shaped structure.

2. The electrical device according to claim 1, wherein said textile sheet-shaped structure is a non-woven fabric.

3. The electrical device according to claim 2, wherein said insulating body includes capacitive control inserts and insulating layers separating said capacitive control inserts from one another, said insulating layers are formed of said non-woven fabric, and said control inserts are disposed concentrically around said inner conductor and extend into said plug-in section.

4. The electrical device according to claim 3, wherein said non-woven fabric includes a synthetic polymer.

5. The electrical device according to claim 3, wherein said control inserts are spaced apart by a radial distance of between 1 mm and 3 mm.

6. The electrical device according to claim 5, wherein said radial distance between said control inserts has a variation of less than 0.5 mm.

7. The electrical device according to claim 5, wherein said radial distance between said control inserts has a variation of less than 0.2 mm.

8. The electrical device according to claim 1, wherein said insulating body includes a cured resin.

9. The electrical device according to claim 1, wherein the high-voltage bushing extends in a longitudinal direction over a length of 6 meters to 30 meters.

10. The electrical device according to claim 1, wherein said inner conductor has a diameter of at least 5 centimeters.

11. The electrical device according to claim 1, wherein said plug-in section includes an outer coating of a flexible insulating coating material.

12. The electrical device according to claim 1, which further comprises:

a hollow locating section formed of an electrically non-conductive insulating material and extending from said fastening section into said housing; and a metallic contact part disposed at a closed and tapered end region, said metallic contact part extending through said insulating material of said locating section or prolonging said locating section in a direction of said closed and tapered end region.

13. The electrical device according to claim 12, which further comprises a winding connection line extending within said housing, said winding connection line connecting said contact part to a winding.

14. The electrical device according to claim 13, wherein said winding connection line is equipped with a current sensor.

15. The electrical device according to claim 1, wherein said device connection part has a curved outer surface disposed in said fluid-tight housing.

* * * * *